United States Patent [19]

Oseto et al.

[11] Patent Number: 4,508,806

[45] Date of Patent: Apr. 2, 1985

[54] ELECTROPHOTOGRAPHIC TONER COMPOSITION

[75] Inventors: Osamu Oseto; Fumio Moriuchi, both of Suita, Japan

[73] Assignee: Arakawa Kagaku Kogyo Kabushiki Kaisha, Osaka, Japan

[21] Appl. No.: 514,049

[22] Filed: Jul. 15, 1983

[30] Foreign Application Priority Data

May 9, 1983 [JP] Japan ..... 58-80477

[51] Int. Cl.[3] ..... G03G 9/08

[52] U.S. Cl. ..... 430/109; 527/604; 430/904

[58] Field of Search ..... 527/604; 430/106, 107, 430/109, 904

[56] References Cited

U.S. PATENT DOCUMENTS 3,239,465 3/1966 Rheinfrank ..... 430/109

*Primary Examiner*—John D. Welsh

*Attorney, Agent, or Firm*—Antonelli, Terry & Wands

[57] ABSTRACT

An electrophotographic toner composition having excellent blocking resistance and offset resistance which contains as a resin binder a polymeric rosin compound having a glass transition temperature of 30° and 100° C. and a gel fraction of 1 to 99% to xylene prepared by the reaction of (a) a glycidyl ester of rosin, (b) a dicarboxylic acid or its anhydride, and (c) a crosslinking agent selected from the group consisting of a polyfunctional epoxy compound, a polycarboxylic acid having a valency of not less than 3 or its anhydride, and a polyhydric alcohol having a valency of not less than 3. A dihydric alcohol may be used in the above reaction in order to improve the low temperature fixing property of the toner.

9 Claims, No Drawings

ELECTROPHOTOGRAPHIC TONER COMPOSITION

BACKGROUND OF THE INVENTION

The present invention relates to a toner composition for electrophotography, and more particularly to an electrophotographic toner composition having excellent blocking resistance and offset resistance which contains a rosin type polymeric compound as a binder.

Various electrophotographic methods are hitherto known. There is generally known a method in which a latent electrostatic image is formed on a photosensitive body utilizing a photoconductive material by various means and is then developed with a toner, and after transferring the toner image to a support such as paper if necessary, the toner image is fixed by heating, applying a pressure or using a solvent.

In recent years, a high speed fixing property is required for the toner in order to increase the efficiency of the copying operation. Attempts such as using a thermoplastic resin having a lower softening point and being easily heat fusible as a toner binder to be used in a conventional heat fixing method have been made to provide a toner composition satisfying the requirement. However, mere lowering of the softening point of a resin binder has the defect of causing agglomeration of toner particles, namely blocking phenomenon, during use. Accordingly, as one system for high speed fixing, there has been utilized a fixing method using a heat roller having a good heat conductivity.

Since the heat roller system is higher in heat efficiency than the heat fixing system, a toner can be fixed in a shortened period of time. However, sticking of the toner to the heat roller, namely the so-called offset phenomenon, frequently occurs, since the toner is directly brought into contact with the heat roller. Accordingly, it has been desired to develop a resin capable of solving this problem.

A styrene-acrylate copolymer, a styrene-butadiene copolymer and a styrene-acrylonitrile copolymer are usually known as a resin binder for a toner. These vinyl copolymers are in general poor in offset resistance and flowability. One of other resin binders is a bisphenol type epoxy resin. The bisphenol type epoxy resin provides a toner having superior flowability and fixing property because of having a lower molecular weight as compared with the vinyl copolymer binder. But, it has a tendency to lowering the offset resistance, because the melt viscosity of the resin is low. Also, various polyester resins are proposed as toner binders having excellent offset resistance and flowability.

It is an object of the present invention to provide a novel resin binder for a toner used in electrophotography having excellent blocking resistance, offset resistance and low temperature flowability.

A further object of the invention is to provide an electrophotographic toner composition having excellent blocking resistance, offset resistance and low temperature flowability.

These and other objects of the present invention will become apparent from the description hereinafter.

SUMMARY OF THE INVENTION

In accordance with the present invention, there is provided a toner composition for electrophotography comprising a resin binder and a colorant, said resin binder being a polymeric rosin compound having a glass transition temperature of 30° to 100° C. and a gel fraction of 1 to 99% to xylene and being prepared by the reaction of:

(a) a glycidyl ester of rosin, (b) a dicarboxylic acid or a dicarboxylic acid anhydride, and (c) at least one crosslinking agent selected from the group consisting of a polyfunctional epoxy compound, a polybasic acid having a valency of not less than 3 and its anhydride, and a polyhydric alcohol having a valency of not less than 3.

DETAILED DESCRIPTION

The glycidyl ester of rosin (a) used in the present invention can be prepared by reacting rosin and an epihalohydrin in the presence of a basic compound such as an organic amine with heating. Examples of the rosin are, for instance, natural rosins such as gum rosin, wood rosin and tall oil rosin, and modified rosins obtained by modifying the natural rosins such as hydrogenated rosin and disproportionated rosin. Abietic acid, dehydroabietic acid, dihydroabietic acid, pimaric acid and isopimaric acid which are effective components of rosin, are also employed in the invention. Tertiary amines and onium salts thereof are preferred as the above-mentioned organic amines. Typical examples of the tertiary amines are triethylamine, dimethylbenzylamine, methyldibenzylamine, tribenzylamine, dimethylaniline, dimethylcyclohexylamine, methyldicyclohexylamine, tripropylamine, tributylamine, N-phenylmorpholine, N-methylpiperidine and pyridine. Typical examples of the onium salts of tertiary amines are tetramethylammonium chloride, tetramethylammonium bromide, benzyltriethylammonium chloride, allyltriethylammonium bromide, tetrabutylammonium chloride, methyltrioctylammonium chloride, trimethylamine hydrochloride, triethylamine hydrochloride and pyridine hydrochloride.

The dicarboxylic acid and dicarboxylic acid anhydride (b) (these compounds being hereinafter referred to as "dicarboxylic acid compound") used in the present invention include, for instance, orthophthalic acid, isophthalic acid, terephthalic acid, endomethylenetetrahydrophthalic acid, tetrahydrophthalic acid, methyltetrahydrophthalic acid, hexahydrophthalic acid, methylhexahydrophthalic acid, maleic acid, fumaric acid, succinic acid, adipic acid, azelaic acid, sebacic acid, alkenylsuccinic acids having 8 to 18 carbon atoms, alkylsuccinic acids having 8 to 18 carbon atoms, and anhydrides thereof.

At least one of a polyfunctional epoxy compound, a polybasic acid having a valency of not less than 3, an anhydride of the polybasic acid and a polyhydric alcohol having a valency of not less than 3 is employed as a crosslinking agent (c) in the present invention.

Typical examples of the polyfunctional epoxy compound are an epoxy resin obtained by condensation of bisphenol A and an epihalohydrin, and rosin diepoxide or rosin triepoxide which is a reaction product of acrylic acid-modified rosin or fumaric acid-modified rosin with an epihalohydrin. In the preparation of the above-mentioned polyepoxides, rosin as used in the preparation of the rosin glycidyl ester can be used.

Typical examples of the polybasic acid having a valency of not less than 3 and the anhydride thereof are polycarboxylic acids such as trimellitic acid and pyromellitic acid, and the anhydrides thereof.

Typical examples of the polyhydric alcohol having a valency of not less than 3 are glycerol, trimethylolethane, trimethylolpropane and pentaerythritol.

The polymeric rosin compound used as a binder in the present invention is prepared, for instance, by a process in which the rosin glycidyl ester (a), the dicarboxylic acid compound (b) and the crosslinking agent (c) are charged at once, and reacted with heating in the presence or absence of the above-mentioned organic amine as a catalyst, or a process in which the rosin glycidyl ester (a) and the dicarboxylic acid compound (b) are reacted with heating in the presence or absence of the organic amine, the crosslinking agent (c) is then added in the course of or after the completion of the above reaction, and the reaction is further continued with heating.

The ratio of the rosin glycidyl ester (a) to the dicarboxylic acid compound (b) is from 1.5:1.0 to 1.0:1.5 by mole, preferably 1:1 by mole.

The amount of the crosslinking agent (c) should be carefully determined, since it has a great influence on the physical properties of the obtained binder resin, especially on the molecular weight and the molecular weight distribution. In case of using the polyfunctional epoxy compound as a crosslinking agent, the amount thereof is determined in consideration of the number of functional groups, namely the epoxy equivalent. For instance, triglycidyl ester of fumaric acid-modified rosin is employed in an amount of 0.005 to 0.07 mole, preferably 0.005 to 0.04 mole, per mole of the total of the rosin glycidyl ester (a) and the dicarboxylic acid compound (b). A bisphenol type epoxy resin which is commercially available, is employed in an amount of 0.005 to 0.14 mole, preferably 0.005 to 0.07 mole, per mole of the total of the ingredients (a) and (b). The amounts of the polybasic acid or its anhydride and the polyhydric alcohol are also determined in consideration of the number of functional groups thereof. For instance, in case that they are trivalent compounds, they are employed in an amount of 0.005 to 0.3 mole, preferably 0.005 to 0.15 mole, per mole of the total of the rosin glycidyl ester (a) and the dicarboxylic acid compound (b).

It is not always necessary to conduct the reaction in the presence of the organic amine catalyst. The catalyst may be employed depending on the kind of the used dicarboxylic acid compound for the purpose of shortening the reaction time. The catalyst is employed in an amount of 0.01 to 5% by weight, preferably 0.05 to 1% by weight, based on the rosin glycidyl ester (a).

Although the polymeric rosin compound used as a binder resin can be obtained in a good yield regardless of the presence or absence of a solvent, a solvent may be employed to smoothly remove the produced water outside the reaction system. The solvent is selected in consideration of the azeotropic property with water and the nonreactivity to the ingredients (a), (b) and (c). Typical examples of the solvent are toluene and xylene.

The reaction temperature and the reaction time are suitably determined in consideration of the yield and the gel fraction of the product. The reaction time is usually selected from 0.5 to 10 hours, especially 1 to 8 hours. In case of using the dicarboxylic acid anhydride as an ingredient (b), the reaction temperature is usually selected from 100° to 250° C., especially 130° to 180° C. In case of using the dicarboxylic acid as an ingredient (b), the reaction time is usually selected from 150° to 300° C., especially 180° to 260° C. Also, in case that a solvent has been employed upon the reaction, the product can be obtained as a solid by distilling away the solvent under reduced pressure. It is important that the gel fraction of the product to xylene is from 1 to 99% by weight, since the offset resistance can be further improved as compared with the product having a gel fraction of less than 1%. The end point of the reaction can be easily determined by suitably measuring the gel fraction to xylene. The term "gel fraction" as used herein means the percentage of the portion insoluble in xylene of the product.

The polymeric rosin compound used as a binder for a toner in the present invention can be obtained in high yields by the process as mentioned above. From the viewpoints of the characteristics required for an electrophotographic toner composition such as blocking resistance, offset resistance and low temperature flowability, it is necessary that the polymeric rosin compound has a glass transition temperature of 30° to 100° C. and a gel fraction to xylene of 1 to 99% by weight. When the glass transition temperature is less than 30° C., the toner is poor in offset resistance, and when the glass transition temperature is more than 100° C., the toner is poor in low temperature flowability. Also, when the gel fraction is less than 1% the offset resistance is inferior. The polymeric rosin compound having a gel fraction of more than 99% is hard to prepare and moreover the workability in preparing a toner such as kneading with carbon black is bad.

A dihydric alcohol may be employed in the reaction of the ingredients (a), (b) and (c) in order to control the glass transition temperature of the obtained polymeric rosin compound, thus improving the fixing property of a toner composition at low temperatures. The dihydric alcohols used in the present invention are not particularly limited. Representative examples of the dihydric alcohols are, for instance, ethylene glycol, diethylene glycol, triethylene glycol, propylene glycol, 1,2-butanediol, 1,3-butanediol, 1,4-butanediol, bisphenol A, hydrogenated bisphenol A, ethoxy-substituted bisphenol A and propoxy-substituted bisphenol A. The amount of the dihydric alcohol is suitably determined in consideration of the glass transition temperature of the obtained polymeric rosin compound. Usually, up to 70% by mole, especially 1 to 70% by mole, more especially 20 to 70% by mole, of the rosin glycidyl ester to be used can be replaced with the dihydric alcohol.

Conventionally known colorants can be employed in the present invention, e.g. carbon black, nigrosine dye, aniline blue, Calco Oil Blue, chrome yellow, ultra marine blue, Quinoline Yellow, methylene blue chloride, phthalocyanine blue, Malachite Green Oxalate, lamp black, Rose Bengal and Monastral Red. The colorant should be present in the toner composition in an amount sufficient to render it colored so that it will form a clearly visible image on a recording member. The colorant is employed usually in an amount of 1 to 20% by weight based on the total weight of the toner composition.

Known carrier materials such as magnetic substances can be employed for the toner composition of the present invention. Typical carriers include, for instance, a metal powder such as iron, steel, manganese, nickel, cobalt and chromium, an iron alloy such as ferrite and magnetite, an alloy or compound of a metal such as cobalt, nickel or manganese, and known ferromagnetic substances.

The present invention is more specifically described and explained by means of the following Examples. It is to be understood that the present invention is not limited to the Examples, and various changes and modifications may be made in the invention without departing from the spirit and scope thereof.

The following Reference Examples are presented to illustrate the preparation of rosin glycidyl esters and the preparation of a rosin epoxide crosslinking agent as used in the present invention.

REFERENCE EXAMPLE 1

A glycidyl ester of disproportionated rosin was prepared as follows: A 500 ml. flask equipped with a stirrer and a reflux condenser was charged with 100 g. of disproportionated rosin (acid value: 162, softening point: 79° C.) having a purity of 87% (the residual 13% portion being non-hydrolysate), 200 g. of epichlorohydrin and 0.1 g. of benzyltrimethylammonium chloride. The reaction was carried out at 80° C. for 4 hours. To the flask was added 16 g. of particulate sodium hydroxide by instalments. The temperature was elevated to 100° C. and the reaction was further continued at 100° C. for 2 hours. The deposited sodium chloride was filtered, and the unreacted epichlorohydrin was distilled away from the filtrate by a rotary evaporator. Further, a volatile material was completely removed at 120° C. and 2 mmHg to give an oily light yellow product (yield 97.2%). The thus obtained rosin glycidyl ester had an acid value of 0 and an epoxy equivalent of 425. The purity calculated on the basis of the epoxy equivalent was 84%.

REFERENCE EXAMPLES 2 to 4

The procedure of Reference Example 1 was repeated except that, instead of the disproportionated rosin, there was employed gum rosin having a purity of 91%, an acid value of 169 and softening point of 75° C. (Reference Example 2), hydrogenated rosin having a purity of 89%, an acid value of 165 and a softening point of 74° C. (Reference Example 3) or tall oil rosin having a purity of 87%, an acid value of 163 and a softening point of 73° C. (Reference Example 4).

The rosin glycidyl ester obtained in Reference Example 2 had an acid value of 0, an epoxy equivalent of 436.5 and a purity of 82.1%. The rosin glycidyl ester obtained in Reference Example 3 had an acid value of 0, an epoxy equivalent of 431.6 and a purity of 83.5%. The rosin glycidyl ester obtained in Reference Example 4 had an acid value of 0, an epoxy equivalent of 445.5 and a purity of 80.0%.

REFERENCE EXAMPLE 5

A triglycidyl ester of fumaric acid-modified rosin usable as a crosslinking agent in the present invention was prepared as follows: In a nitrogen stream, 300 g. of gum rosin having a purity of 91%, an acid value of 169 and a softening point of 75° C. was molten at a temperature of 140° to 160° C. After adding 116 g. of crystalline fumaric acid thereto, the mixture was heated to a temperature of 200° to 220° C. and was reacted at that temperature for 2 hours with agitation to give fumaric acid-modified rosin.

A flask was charged with 100 g. of the fumaric acid-modified rosin, 500 g. of epichlorohydrin and 0.1 g. of benzyltrimethylammonium chloride, and the reaction was carried out at 80° C. for 4 hours. To the flask was added 28.8 g. of particulate sodium hydroxide by instalments. The temperature was elevated to 110° C., and the reaction was further continued at 110° C. for 2 hours under reflux, while removing the produced water by a trap. The deposited sodium chloride was filtered, and the unreacted epichlorohydrin was distilled away from the filtrate at 120° C. and 2 mmHg to give a balsam-like triglycidyl ester of fumaric acid-modified rosin. The product had an acid value of 0 and an epoxy equivalent of 337.

EXAMPLE 1

A flask was charged with 375 g. of the glycidyl ester of disproportionated rosin obtained in Reference Example 1, 148.0 g. of phthalic anhydride and 7.1 g. of the triglycidyl ester of fumaric acid-modified rosin obtained as a crosslinking agent in Reference Example 5. The reaction was carried out at 180° C. for 3 hours in a nitrogen stream. At that temperature, the reaction was further carried out for 3 hours, while measuring the gel fraction to xylene.

The obtained resin was light yellow, and had a glass transition temperature of 73° C. The gel fraction to xylene was 63%.

EXAMPLE 2

The procedure of Example 1 was repeated except that the kinds and amounts of the starting materials were changed as shown in Table 1, to give a light yellow resin. The properties thereof are shown in Table 1.

EXAMPLE 3

A flask was charged with 450 g. of the glycidyl ester of disproportionated rosin obtained in Reference Example 1 and 166.0 g. of isophthalic acid, and the esterification reaction was carried out at a temperature of 240° to 250° C. for 3 hours in a nitrogen stream, while removing the produced water outside the system. After elevating the temperature of the system to 270° to 280° C. and adding 26.4 g. of trimellitic anhydride, the reaction was further conducted for 3 hours, while measuring the gel fraction to xylene. The properties of the obtained light yellow resin are shown in Table 1.

EXAMPLES 4 to 8

The procedures of Example 1 were repeated except that the kinds and amounts of the starting materials were changed and in Examples 6 to 8 dihydric alcohols were further employed as shown in Table 1, to give light yellow resins, respectively. The properties of the resins are shown in Table 1.

COMPARATIVE EXAMPLE 1

The procedure of Example 1 was repeated except that the reaction time was shortened to 3 hours and the crosslinking agent was employed in an amount of 3.3 g., to give a light yellow resin. The properties of the resin are shown in Table 1.

COMPARATIVE EXAMPLE 2

A flask was charged with 542 g. of the disproportionated rosin glycidyl ester obtained in Reference Example 1, 340 g. of isophthalic acid and 145 g. of triethylene glycol. The esterification reaction was carried out at a temperature of 240° to 250° C. for 6 hours in a nitrogen stream. The properties of the obtained light yellow resin are shown in Table 1.

COMPARATIVE EXAMPLE 3

In a nitrogen stream, 358 g. of the disproportionated rosin glycidyl ester obtained in Reference Example 1, 415 g. of isophthalic acid and 105 g. of glycerol were reacted at a temperature of 240° to 250° C. for 4 hours. The properties of the obtained light yellow resin are shown in Table 1.

Toner compositions were prepared by employing as binders the resins obtained in Examples 1 to 8 and Comparative Examples 1 to 3 and the characteristics thereof were tested as follows:

TABLE 1

| | Starting material (g.) | | | | Glass transition temperature (°C.) | Gel fraction (%) |
|---|---|---|---|---|---|---|
| | Glycidyl ester | Dicarboxylic acid compound | Crosslinking agent | Dihydric alcohol | | |
| Ex. 1 | Ref. Ex. 1 (375) | Phthalic anhydride (148) | Ref. Ex. 5 (7.1) | — | 73 | 63 |
| Ex. 2 | Ref. Ex. 2 (375) | Hexahydrophthalic anhydride (166) | Ref. Ex. 5 (8.5) | — | 58 | 34 |
| Ex. 3 | Ref. Ex. 1 (450) | Isophthalic acid (166) | Trimellitic anhydride (26.4) | — | 66 | 45 |
| Ex. 4 | Ref. Ex. 3 (260) | Isophthalic acid (166.5) | Glycerol (20.0) | — | 62 | 56 |
| Ex. 5 | Ref. Ex. 4 (330) | Terephthalic acid (166) | Bisphenol A type liquid epoxy resin (26.5) | — | 71 | 8.4 |
| Ex. 6 | Ref. Ex. 1 (542) | Terephthalic acid (340) | Trimellitic anhydride (10) | Triethylene glycol (145) | 65 | 52.2 |
| Ex. 7 | Ref. Ex. 2 (374) | Isophthalic acid (11.5) | Bisphenol A type liquid epoxy resin (26.8) | Bisphenol A (196) | 79 | 43.1 |
| Ex. 8 | Ref. Ex. 1 (550) | Terephthalic acid (380) | Ref. Ex. 5 (4.2) | 1,4-Butanediol (120) | 53 | 22.8 |
| Com. Ex. 1 | Ref. Ex. 1 (375) | Phthalic anhydride (148) | Ref. Ex. 5 (3.3) | — | 79 | 0 |
| Com. Ex. 2 | Ref. Ex. 1 (542) | Isophthalic acid (340) | — | Triethylene glycol (145) | 62 | 0 |
| Com. Ex. 3 | Ref. Ex. 1 (358) | Isophthalic acid (415) | Glycerol (105) | — | 82 | 99.5 |

After mixing 95 parts by weight of each of the resins obtained in the Examples and Comparative Examples and 5 parts by weight of carbon black by a ball mill, the mixture was kneaded by a heat roll and cooled. The mixture was then finely divided by a jet pulverizer to give a toner having an average particle size of 13 to 15 μm.

To 5 parts by weight of the toner was added 95 parts by weight of an iron powder carrier to give a developer. A latent electrostatic image was developed therewith by employing an electrophotographic copying machine, and it was transferred to and then fixed to a plain paper by employing a fixing roller having a polytetrafluoroethylene coated surface.

At that time, the temperature of the fixing roller was variously changed, and the fixing state of the toner was estimated. That is to say, a black ribbon image was fixed to a copy sheet by the above-mentioned method, and a cellophane adhesive tape was stuck thereto and immediately peeled off. The fixing property of the toner was estimated by light transmission of the tape.

The offset phenomenon, namely transferring of the fixed image to the roller, was then examined by bringing the fixing roller into contact with a new white paper under pressure immediately after fixing the toner image to a copy sheet, and observing the presence of the toner contamination on the white paper by the naked eye. The offset resistance was estimated according to the following criteria.

O: No offset

Δ: Slight offset

X: Large offset

The blocking resistance was estimated by applying 500 g. load to the toner, allowing to stand for 2 hours at a temperature within 50° to 65° C., observing the state of blocking and measuring the temperature at which blocking occurs.

The results are shown in Table 2.

In case of the resin obtained in Comparative Example 3, a toner could not be prepared because of difficulty in kneading with carbon black. Therefore, it was impossible to make the test.

TABLE 2

| | Temperature of blocking occurrence (°C.) | Offset resistance | | | Fixing property (%) | | |
|---|---|---|---|---|---|---|---|
| | | 170° C. | 200° C. | 240° C. | 150° C. | 170° C. | 200° C. |
| Ex. 1 | 60 | O | O | O | 85 | 90 | 98 |
| Ex. 2 | 43 | O | O | Δ | 89 | 94 | 99 |
| Ex. 3 | 55 | O | O | O | 88 | 95 | 98 |
| Ex. 4 | 54 | O | O | O | 90 | 94 | 98 |
| Ex. 5 | 56 | O | O | Δ | 88 | 95 | 99 |
| Ex. 6 | 50 | O | O | O | 90 | 95 | 99 |
| Ex. 7 | 55 | O | O | O | 83 | 92 | 97 |
| Ex. 8 | 48 | O | O | Δ | 81 | 89 | 96 |
| Com. Ex. 1 | 65 | X | X | X | 82 | 88 | 96 |
| Com. Ex. 2 | 50 | X | X | X | 85 | 90 | 96 |
| Com. Ex. 3 | — | — | — | — | — | — | — |

In addition to the ingredients used in the Examples, other ingredients can be used in the Examples as set forth in the specification to obtain substantially the same results.

What we claim is:

1. A toner composition for electrophotography comprising a resin binder and a colorant, said resin binder being a polymeric rosin compound having a glass transition temperature of 30° to 100° C. and a gel fraction of 1 to 99% to xylene and being prepared by the reaction of:

(a) a glycidyl ester of rosin, (b) a dicarboxylic acid or a dicarboxylic acid anhydride, and (c) at least one crosslinking agent selected from the group consisting of a polyfunctional epoxy compound, a polybasic acid having a valency of not less than 3 and its anhydride, and a polyhydric alcohol having a valency of not less than 3.

2. The composition of claim 1, wherein said polymeric rosin compound is prepared by the reaction of:

(a) a glycidyl ester of rosin, (b) a dicarboxylic acid or a dicarboxylic acid anhydride, (c) at least one crosslinking agent selected from the group consisting of a polyfunctional epoxy compound, a polybasic acid having a valency of not less than 3 and its anhydride, and a polyhydric alcohol having a valency of not less than 3, and (d) a dihydric alcohol.

3. The toner composition of claim 1, wherein said glycidyl ester of rosin (a) and said dicarboxylic acid or dicarboxylic acid anhydride (b) are reacted in a ratio of the rosin glycidyl ester (a) to the dicarboxylic acid or dicarboxylic acid anhydride (b) of from 1.5:1.0 to 1.0:1.5 by mole.

4. The composition of claim 1, wherein said crosslinking agent (c) is a triglycidyl ester of fumeric acid-modified rosin and is employed in an amount of 0.005 to 0.07 mole, per mole of the total of the component (a) and the component (b).

5. The composition of claim 1, wherein said crosslinking agent (c) comprises a bisphenol type of epoxy resin and is employed in an amount of 0.005 to 0.14 mole, per mole of the total of components (a) and (b).

6. The composition of claim 1, wherein said crosslinking agent (c) comprises a polybasic acid or its anhydride or a polyhydric alcohol and is employed in an amount of 0.005 to 0.3 mole, per mole of the total of component (a) and component (b).

7. The composition of claim 1, wherein said reaction between components (a), (b) and (c) is conducted in the presence of an organic amine catalyst and the catalyst is employed in an amount of 0.01 to 5% by weight based on the rosin glycidyl ester (a).

8. The composition of claim 1, wherein said reaction of component (a), (b) and (c) is effected for 0.5 to 10 hours at 100° to 250° C. when (b) is a dicarboxylic acid anhydride and at 150° to 300° C. when (b) is a dicarboxylic acid.

9. The composition of claim 2, wherein said glycidyl ester of rosin and said dicarboxylic acid or dicarboxylic acid anhydride are employed in such an amount that the ratio of (a) to (b) is from 1.5:1.0 to 1.0:1.5 by mole and from 1 to 70% by mole of the rosin glycidyl ester (a) is replaced with the dihydric alcohol (d).

* * * * *